United States Patent [19]

Vick

[11] Patent Number: 5,066,220

[45] Date of Patent: Nov. 19, 1991

[54] CIGARETTE LIGHTER

[76] Inventor: Henry L. Vick, 24-7 Westchester Ct., Birmingham, Ala. 35215

[21] Appl. No.: 519,737

[22] Filed: May 7, 1990

[51] Int. Cl.[5] ..... F23D 11/36

[52] U.S. Cl. ..... 431/277; 431/153; 431/267

[58] Field of Search ..... 431/140, 141, 144, 138, 431/139, 133, 135, 136, 137, 273, 274, 275, 276, 267, 277, 153

[56] References Cited

U.S. PATENT DOCUMENTS

| | | | |
|---|---|---|---|
| 1,944,177 | 1/1934 | Holtzman | 431/138 |
| 2,501,841 | 3/1950 | Burchett | 431/276 X |
| 3,224,235 | 12/1965 | Meylan | 431/276 X |
| 4,830,603 | 5/1989 | Cirami | 431/153 |
| 4,832,596 | 5/1989 | Morris, Sr. | 431/153 |
| 4,859,172 | 8/1989 | Nitta | 431/153 |

FOREIGN PATENT DOCUMENTS

| | | | |
|---|---|---|---|
| 1248630 | 10/1959 | France | 431/254 |
| 1428580 | 1/1965 | France | 431/254 |
| 82097 | 7/1965 | France | 431/254 |

*Primary Examiner*—Carl D. Price

*Attorney, Agent, or Firm*—Jennings, Carter, Thompson & Veal

[57] ABSTRACT

A safety mechanism, for a lighter having a striker and a flint for creating sparks and/or a lever for releasing compressed flammable gas adjacent the striker and flint, including a spring for biasing the striker and flint apart when the lighter is not in use and means for selectively urging the striker and flint together to facilitate a spark. The safety mechanism may further include a pivotal stop member which typically secures the lever in a non-releasing position until selectively pivoted therefrom by the operator.

22 Claims, 3 Drawing Sheets

CIGARETTE LIGHTER

FIELD OF THE INVENTION

The present invention relates to cigarette lighters and more particularly to safety mechanisms for preventing the inadvertent ignition of flammable gas supplied by such cigarette lighters. In greater particularity, the present invention relates to apparatus for disengaging the spark creating components of a cigarette lighter and apparatus for disabling the gas supplying components of a cigarette lighter.

BACKGROUND OF THE INVENTION

Cigarette lighters create a flame by making a spark directly adjacent a flow of flammable vapor. The flow of flammable vapor may be facilitated by the selected release of compressed flammable liquid from a pressurized holding tank included on the lighter or by the conveyance of flammable liquid from an atmospheric tank via a wick wherein the liquid evaporates adjacent the spark creating means.

The spark creating means typically consists of a spark generator usually a flint which is fixably secured in abutment with a rotatable abrasive striker or may be a piezzo electric crystal. As the striker is rotated, sparks are created by the contact of the striker and the flint. If a wick type lighter is used, the sparks ignite the evaporating flammable liquid creating a flame. If pressurized gas is used, the operator usually depresses a lever with the downward motion of the digit chosen to rotate the striker, thereby releasing the pressurized gas which is consequently ignited by the near simultaneous creation of the sparks.

The use of a digit, typically the thumb, to rotate the striker and depress the lever in simultaneous sequence is an activity requiring little coordination, being easily copied by small children who may be unaware of the consequences of this action. Cigarette lighter manufacturers have improved the ignition procedure by eliminating the use of an individually operated striker substituting instead a piezzo electric crystal and creating a lighter wherein the striker and the gas supplying means are simultaneously and collectively activated by the depression of a single lever. In the pursuit of easily ignited cigarette lighters, the manufacturers have failed to provide such lighters with sufficient safety mechanisms that could prevent small children from causing harm to themselves or others by the inadvertent or mischievous ignition of such lighters.

SUMMARY OF THE INVENTION

It is the principal object of the present invention to provide an improved cigarette lighter that cannot be inadvertently ignited. Yet another object of the invention is to provide such improvements in a form readily adaptable to use with currently existing lighters.

These and other objects and advantages of my invention are accomplished through the use of a lighter having a flint typically biased away from the striker or a striker typically biased from the flint and means for selectively urging the biased component in contact with the other. Contrary to the prior art where the flint and striker were in constant contact, the present invention safely disengages the two spark creating elements until the operator chooses to ignite a flame wherein the two step process of contacting the spark creating elements and subsequently rotating the striker must be performed before a flame will be ignited. A small child would have to know of the safety ignition process, as well as possess sufficient strength and coordination to bias the spark creating elements together before he could create a flame.

BRIEF DESCRIPTION OF THE DRAWINGS

Apparatus embodying features of my invention are depicted in the accompanying drawings which form a portion of this disclosure and wherein.

DESCRIPTION OF A PREFERRED EMBODIMENT

Figure 1:
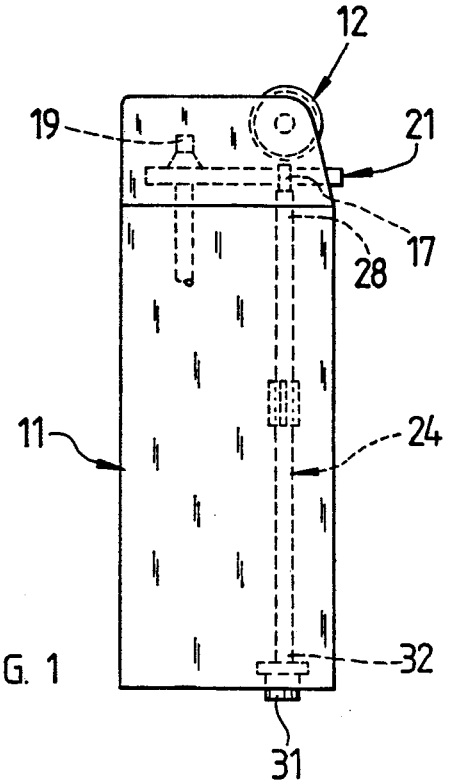
FIG. 1 is a side elevational view of a first embodiment of the present invention.
Figure 2:
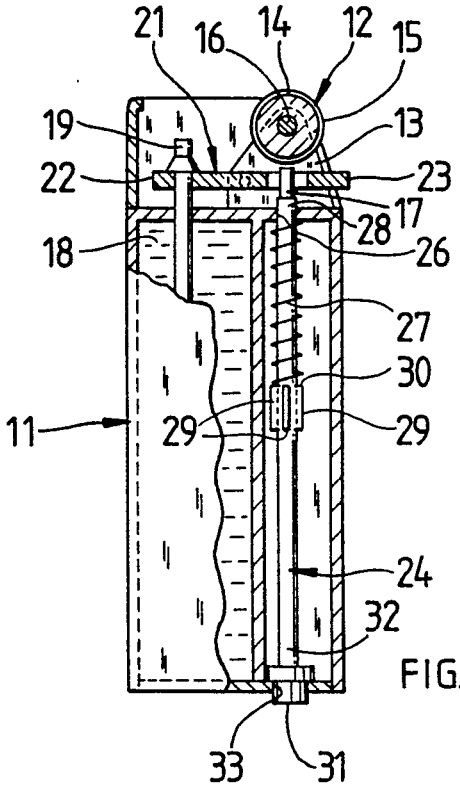
FIG. 2 is a sectional view of FIG. 1.

Referring to the drawings for a clearer understanding of the invention, it should be noted that a first embodiment of the present invention, shown in FIGS. 1-2, contemplates the use of a casing 11 having an abrasive striker 12 mounted thereon for rotation about a horizontal axis. The striker 12 is supported above the casing 11 intermediate a pair of striker mounts 13 which are connected to an upper surface of the casing 11. The striker 12 is cylindrical having an abrasive outer surface 14, a pair of ridged strike flanges 15 and a pair of axially mounted pins 16. The pins 16 are mounted to the striker mounts 13. Mounted to the casing 11, subjacent the striker 12 is a flint 17 but not limited thereto. The flint 17 and the abrasive striker 12 form a means for creating a spark wherein the striker 12, when rotated against the flint 17 in abrasive contact therewith creates frictional energy in the form of sparks. The present invention includes means mounted to the casing 11 for deactivating the spark creating means. The deactivating means includes means for separating the flint 17 and the striker 12 and means for selectively urging the flint 17 in abutment with the striker 12. Mounted to said casing 11 is a means for supplying flammable gas adjacent the spark creating means including a tank 18 mounted within the casing for storing compressed flammable liquid, a valve 19 connected to and in communication with the tank 18 for releasing the flammable liquid in a gaseous form and a lever 21 mounted to the striker mounts 13 for pivotal movement about a horizontal axis having a lift end 22 operatively connected to the valve 19 and a free end 23, wherein the lift end 22 opens the valve 19 when the free end 23 is urged in a downward direction. The separating means is mounted to the casing 11 and includes means for supporting the flint 17 subjacent the striker 12 and means for biasing the supporting means away from the striker 12.

The supporting means includes a shaft 24 slidably engaged within the casing 11 extending upward through an upper portal 26 defined by the casing 11. The biasing means includes a shaft spring 27 mounted to and coiled around the shaft 24 and abutting the casing 11 proximal the upper portal 26, thereby biasing the shaft 24 away from the striker 12. The flint 17 is mounted to an upper end 28 of the shaft 24 for concomitant vertical movement therewith. The shaft 24 includes a plurality of vertical ribs 29 mounted in circumferentially spaced relation thereon a predetermined distance from the upper end 28. Each rib 29 has an upper edge 30, on which the shaft spring 27 rests in biased abutment thereon.

The urging means is mounted to the shaft 24 and includes a button 31 mounted to a lower end 32 of the shaft 24 in axial relation thereto which extends downward through a lower portal 33 defined by the casing 11.

To ignite the gas supplying means, an operator must first press the button 31 upward, thereby urging the flint 17 in abutment with the abrasive outer surface 14 of the striker 12. The operator then rapidly rotates the striker 12 in abrasive contact with the flint 17 with a downward movement of the thumb which ends in depressing engagement with the free end 23 of the lever 21. During the entire ignition procedure, the button 31 must be pressed upward.

Figure 3:
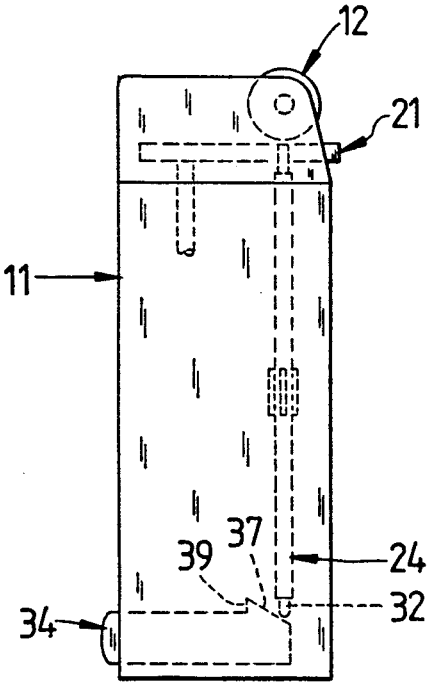
FIG. 3 is a side elevational view of a second embodiment of the present invention.
Figure 4:
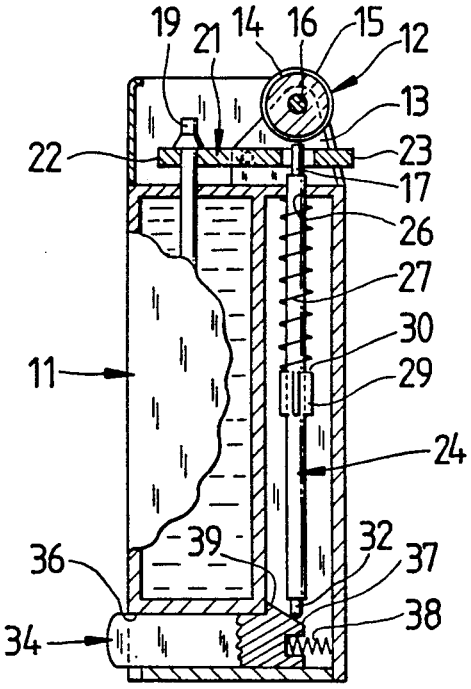
FIG. 4 is a sectional view of FIG. 3.

FIGS. 3–4 show a second embodiment of the present invention wherein the urging means includes a lift member 34 slidably engaged within the casing 11 below and perpendicular the shaft 24, extending through a side portal 36 defined by the casing 11 and having a cam surface 37 carried thereon which subjacently abuts the lower end 32 of the shaft 24. The urging means also includes a cam spring 38 mounted intermediate the lift member 34 and the casing 11 for biasing the lift member 34 away from the lower end 32 of the shaft 24. The lift member 34 has a protuberance 39 which contacts the casing 11 thereby limiting the distance the lift member 34 is biased through the side portal 36.

Figure 5:
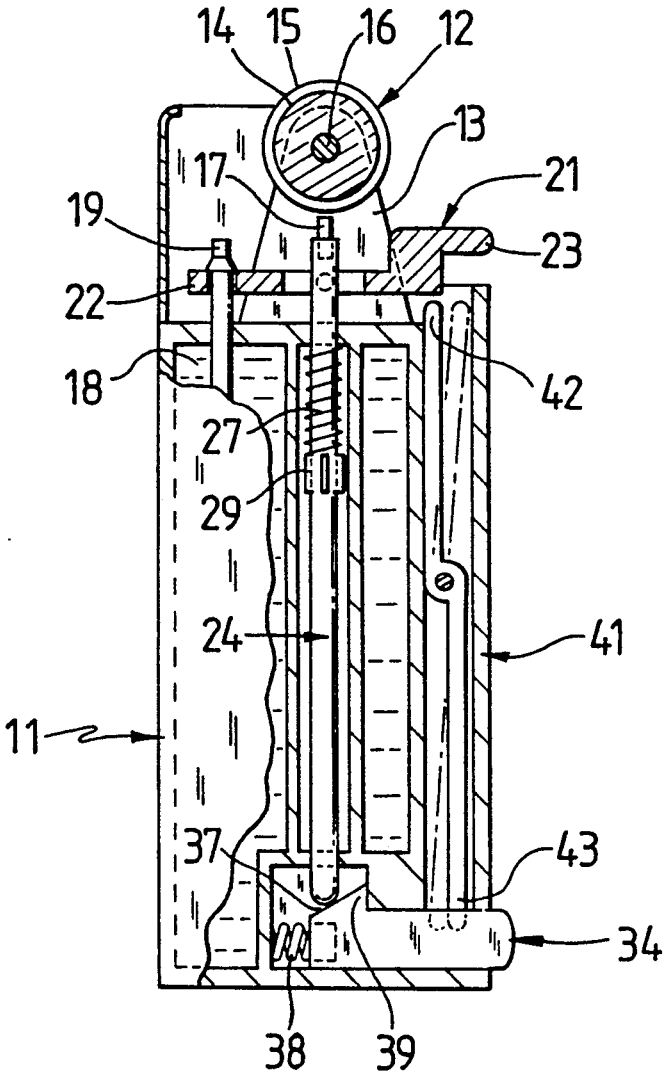
FIG. 5 is a side elevational view of a third embodiment of the present invention partially broken away and in section.
Figure 6:
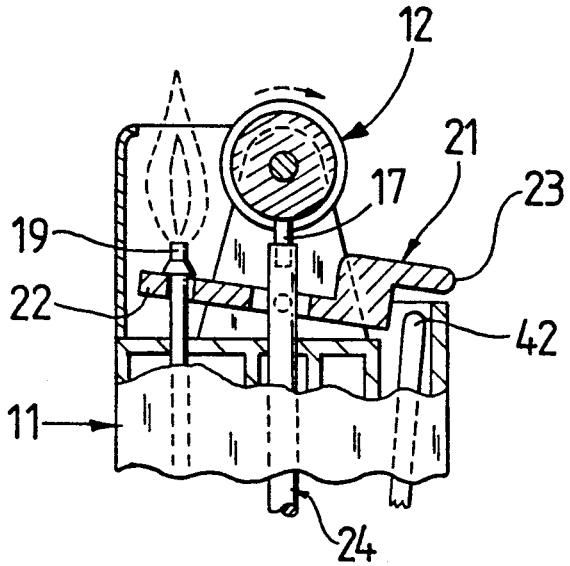
FIG. 6 is an enlargement of the crown portion of the embodiment shown in FIG. 5 while in an operating position.

As shown in FIGS. 5–6, a third embodiment of the present invention contemplates the aforementioned elements described in the second embodiment plus a means mounted to the casing 11 for disabling the gas supplying means. The disabling means comprises an elongated stop member 41 mounted at its midpoint to the casing 11 for pivotal movement about a horizontal axis. The elongated stop member is mounted below and perpendicular the lever 21 and has an upper terminus 42 subjacent the free end 23 in near abutting proximity therewith when the stop member 41 is in a restricting position. The stop member 41 includes a lower terminus 43 pivotally connected to the lift member 34 for concomitant horizontal motion therewith wherein the lift member 34 when selectively urged toward the shaft 24, urges the upper terminus 42 from beneath the free end 23 of the lever 21. The gas supplying means may be disabled by the use of stop member 41 alone when the spark generator comprises a piezzo crystal such that the actuating lever 21 may be disabled. Obviously in this situation no lift member 34 is needed; however the member may be retained as a biasing member.

When using both the second and third embodiments, the lift member 34 must be pressed toward the shaft 24 during ignition to urge the flint 17 against the abrasive surface 14, and in the third embodiment, to remove the stop member 41 from the downward path of the lever 21.

Figure 7:
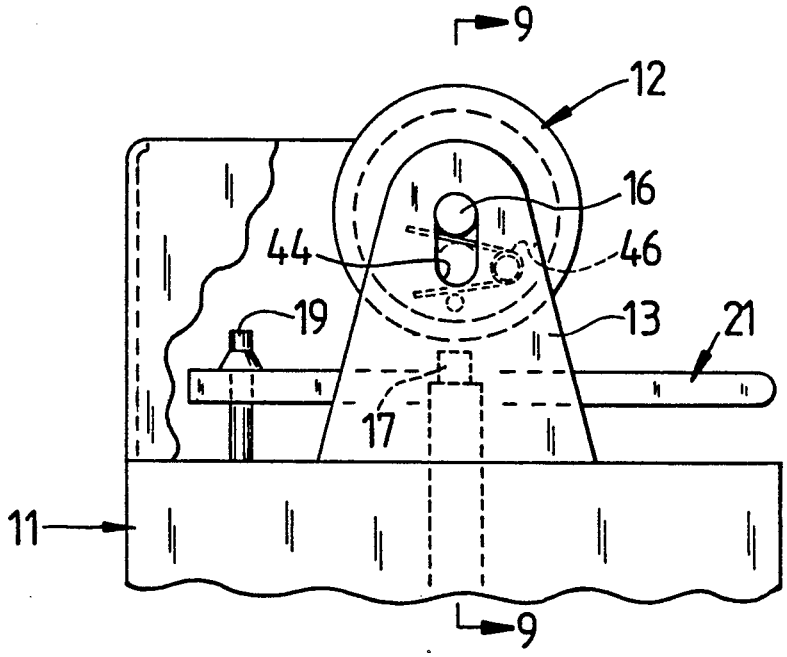
FIG. 7 is a side elevational view partially broken away of a fourth embodiment of my invention.
Figure 8:
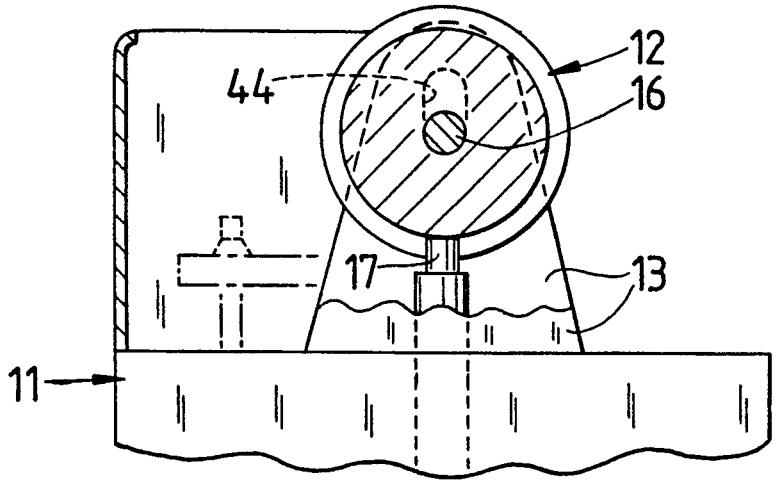
FIG. 8 is a side elevational view partially broken away of the fourth embodiment of my invention in an operating position.
Figure 9:
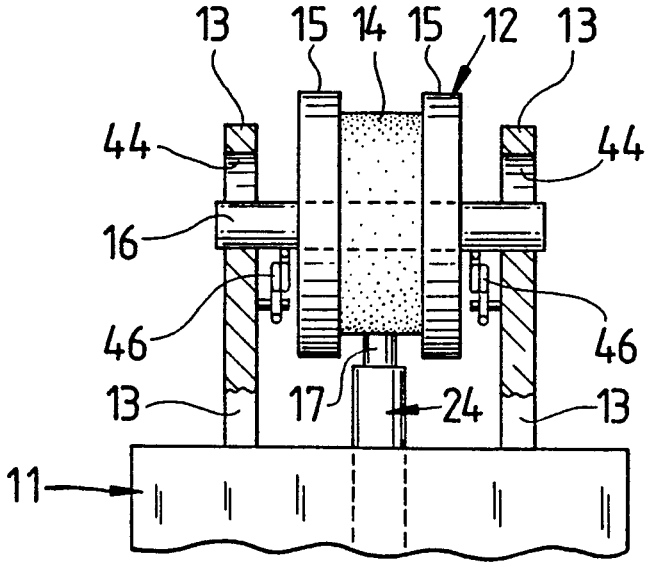
FIG. 9 is a sectional view of FIG. 7 taken along line 9—9 of FIG. 7 in an operative position.

As shown in FIGS. 7–9, a fourth embodiment of the present invention contemplates the pins 16 which support the striker 12 being engaged within vertical slots 44 defined by the striker mounts 13. Pin springs 46 mounted to the striker mounts 13 subjacent the vertical slots 44 abut and upwardly bias the pins 16, and consequently the striker 12, away from the flink 17 fixably mounted thereunder.

To ignite the gas supplying means, the striker 12 must be depressed with a sufficient amount of force to overcome the bias of the pin springs 46 before rotating the striker 12 and subsequently depressing the free end 23 of the lever 21. Preferably, the amount of force required to depress the striker 12 in contact with the flint 17 will be restrictive of such depression by small children.

While I have shown my invention in various forms, it will be obvious to those skilled in the art that it is not so limited but is susceptible of various changes and modifications without departing from the spirit thereof.

What I claim is:

1. A safety mechanism for a lighter having a casing., a means for supplying flammable gases, a flint and an abrasive striker, comprising:

(a) means mounted to said casing for automatically separating said flint from said abrasive striker; and (b) means mounted to said casing for selectively urging said flint into operative abutment with said abrasive striker.

2. A safety mechanism as described in claim 1 further comprising means mounted to said casing for selectively disabling said gas supplying means, wherein said gas supplying means can be selectively reactivated.

3. A safety mechanism as described in claim 1 wherein said separating means comprises:

(a) means mounted to said casing for supporting said flint subjacent said abrasive striker; and (b) means mounted to said supporting means for biasing said supporting means away from said abrasive striker.

4. A safety mechanism as described in claim 3 wherein said supporting means comprises a shaft slidably engaged within said casing and upwardly extending therefrom through an upper portal defined by said casing, being subjacent said abrasive striker, wherein said shaft supports said flint on an upper end thereof.

5. A safety mechanism as described in claim 4 wherein said biasing means comprises a shaft spring mounted to and coiled around said shaft in biased abutment with said casing.

6. A safety mechanism as described in claim 4 wherein said urging means comprises a button mounted to a lower end of said shaft, downwardly extending therefrom through a lower portal defined by said casing.

7. A safety mechanism for a lighter having a casing, a means for supplying flammable gases, a flint and an abrasive striker, comprising:

(a) means mounted to said casing for separating said flint and said abrasive striker, said separating means having:

(i) means mounted to said casing for supporting said flint subjacent said abrasive striker; and (iii) means mounted to said supporting means for biasing said supporting means away from said abrasive striker, wherein said supporting means comprises a shaft slidably engaged within said casing and upwardly extending therefrom through an upper portal defined by said casing, being subjacent said abrasive striker, wherein said shaft supports said flint on an upper end thereof;

(b) means mounted to said casing for selectively urging said slint into operative abutment with said abrasive striker; wherein said urging means has a lift member slidably mounted to said casing below and perpendicular said shaft, extending through a side portal defined by said casing and having a camming surface in subjacent abutment with said shaft for urging said shaft vertically responsive to lateral movement of said lift member.

8. A safety mechanism as described in claim 7 wherein said urging means further comprises a cam spring mounted intermediate said lift member and said casing for biasing said lift member away from said lower end of said shaft.

9. A safety mechanism for a lighter having a casing, a means for creating a spark, a means for supplying a flammable gas adjacent said spark creating means and a lever for activating said gas supplying means, comprising:

(a) means mounted to said casing for restricting the operative movement of said lever, wherein said restricting means comprises an elongated stop member pivotally mounted to said casing below said lever, wherein said stop member upwardly extends in near abutting proximity with a lower surface of said lever when said stop member is in a restricting position; and (b) means mounted to said casing for selectively removing said restricting means from the operative path of said lever, wherein said removing means has:

(i) a biasing member slidably mounted to said casing and engaging said stop member in perpendicular relation thereto, extending from said casing through a side portal defined thereon; and (iii) biasing spring mounted intermediate said casing and said biasing member which biases said biasing member a predetermined distance outward from said casing, thereby biasing said stop member into said restricting position, wherein said biasing member, when selectively forced within said casing, pivots said stop member engaged therein from the operative path of said lever.

10. A cigarette lighter as described in claim 9 wherein said spark creating means comprises:

(a) a pair of striker mounts connected to an upper surface of said casing;

(b) a cylindrical abrasive striker axially mounted intermediate said striker mounts for pivotal movement about a horizontal axis; and (c) a flint mounted to said casing subjacent said abrasive striker.

11. A cigarette lighter as described in claim 10 wherein said deactivating means comprises:

(a) means mounted to said casing for supporting said flint subjacent said abrasive striker; and (b) means mounted to said supporting means for biasing said supporting means away from said abrasive striker.

12. A cigarette lighter for creating a flame comprising:

(a) a casing;

(b) means mounted to said casing for selectively supplying a flammable gas;

(c) means mounted to said casing adjacent said gas supplying means for selectively creating a spark; and (d) means mounted to said casing and said spark creating means for automatically deactivating said spark generating means.

13. A cigarette lighter as described in claim 12 comprising means mounted to said casing for disabling said gas supplying means.

14. A cigarette lighter as described in claim 12 wherein said spark creating means comprises:

(a) a pair of striker mounts connected to an upper surface of said casing;

(b) a cylindrical abrasive striker axially mounted intermediate said striker mounts for pivotal movement about a horizontal axis; and (c) a flint mounted to said casing subjacent said abrasive striker.

15. A cigarette lighter as described in claim 14 wherein said deactivating means comprises:

(a) means mounted to said casing for supporting said flint subjacent said abrasive striker; and (b) means mounted to said supporting means for biasing said supporting means away from said abrasive striker.

16. A cigarette lighter as described in claim 15 wherein said supporting means comprises a shaft slidably mounted within said casing and upwardly extending therefrom through an upper portal defined by said casing, being subjacent said abrasive striker, said shaft supporting said flint on an upper end thereof.

17. A cigarette lighter as described in claim 16 wherein said biasing means comprises a shaft spring mounted to and coiled around said shaft in biased abutment with said casing.

18. A cigarette lighter as described in claim 16 comprising means for selectively urging said flint in operative abutment with said abrasive striker.

19. A cigarette lighter as described in claim 14 wherein said abrasive striker comprises:

(a) a cylindrical drum having an abrasive outer surface; and (b) two pins axially mounted to said drum in opposing extension therefrom, each extending through a vertical slot defined on each said striker mount.

20. A cigarette lighter for creating a flame, comprising:

(a) a casing;

(b) means mounted to said casing for selectively supplying a flammable gas;

(c) means mounted to said casing adjacent said gas supplying means for selectively creating a spark, wherein said spark creating means has:

(i) a pair of striker mounts connected to an upper surface of said casing;

(ii) a cylindrical abrasive striker axially mounted intermediate said striker mounts for pivotal movement about a horizontal axis; and (iii) a flint mounted to said casing subjacent said abrasive striker;

(d) means mounted to said casing and said spark creating means for deactivating said spark generating means, wherein said deactivating means has:

(i) means mounted to said casing for supporting said flint subjacent said abrasive striker; and (ii) means mounted to said supporting means for biasing said supporting means away from said abrasive striker; wherein said supporting means includes comprises a shaft slidably mounted within said casing and upwardly extending therefrom through an upper portal defined by said casing, being subjacent said abrasive striker, said shaft supporting said flint on an upper end thereof; and (e) means for selectively urging said flint in operative abutment with said abrasive striker, wherein said urging means has a lift member slidably mounted to said casing below and perpendicular said shaft extending through a side portal defined by said casing and having a camming surface in subjacent abutment with said shaft.

21. A lighter as described in claim 20 wherein said urging means further comprises a cam spring mounted intermediate said lift member and said casing for biasing said lift member away from said lower end of said shaft.

22. A cigarette lighter for creating a flame, comprising:

(a) a casing;

(b) means mounted to said casing for selectively supplying a flammable gas;

(c) means mounted to said casing adjacent said gas supplying means for selectively creating a spark, wherein said spark creating means has:

(i) a pair of striker mounts connected to an upper surface of said casing;

(ii) a cylindrical abrasive striker axially mounted intermediate said striker mounts for pivotal movement about a horizontal axis, wherein said abrasive striker includes a cylindrical drum having an abrasive outer surface and two pins axially mounted to said drum in opposing extension therefrom, each extending through a vertical slot defined on each said striker mount; and (iii) a flint mounted to said casing subjacent said abrasive striker;

(d) means mounted to said casing and said spark creating means for deactivating said spark generating means, wherein said deactivating means has a pair of pin springs each mounted intermediate said striker mounts and said pins, wherein said pin springs bias said abrasive striker distal said spark nodule.

* * * * *